US009810489B2

(12) United States Patent
Shigemori et al.

(10) Patent No.: US 9,810,489 B2
(45) Date of Patent: Nov. 7, 2017

(54) HEAT EXCHANGER

(71) Applicant: SUMITOMO PRECISION PRODUCTS CO., LTD., Amagasaki-shi, Hyogo (JP)

(72) Inventors: Hideki Shigemori, Hyogo (JP); Koichi Kitagishi, Hyogo (JP); Shozo Hotta, Hyogo (JP)

(73) Assignee: SUMITOMO PRECISION PRODUCTS CO., LTD., Hyogo (JP)

( * ) Notice: Subject to any disclaimer, the term of this patent is extended or adjusted under 35 U.S.C. 154(b) by 227 days.

(21) Appl. No.: 14/778,066

(22) PCT Filed: Mar. 3, 2014

(86) PCT No.: PCT/JP2014/001128
§ 371 (c)(1),
(2) Date: Sep. 17, 2015

(87) PCT Pub. No.: WO2014/147977
PCT Pub. Date: Sep. 25, 2014

(65) Prior Publication Data

US 2016/0282066 A1 Sep. 29, 2016

(30) Foreign Application Priority Data

Mar. 18, 2013 (JP) ..... 2013-055116

(51) Int. Cl.

| | |
|---|---|
| ***F28F 3/00*** | (2006.01) |
| ***F28F 17/00*** | (2006.01) |
| ***F28D 9/00*** | (2006.01) |
| ***F28F 3/02*** | (2006.01) |
| ***F28F 9/18*** | (2006.01) |
| ***F28F 19/00*** | (2006.01) |

(52) U.S. Cl.
CPC ..... *F28F 17/005* (2013.01); *F28D 9/0006* (2013.01); *F28D 9/0037* (2013.01);
(Continued)

(58) Field of Classification Search
CPC . F28D 9/0062; F28F 2265/14; F28F 2265/22; F28F 2265/06; F28F 17/005
(Continued)

(56) References Cited

U.S. PATENT DOCUMENTS 3,372,453 A * 3/1968 Butt ..... F28D 9/0062 165/166
3,451,473 A * 6/1969 Urie ..... F28D 9/0075 165/166

(Continued)

FOREIGN PATENT DOCUMENTS

JP 2006-200864 A 8/2006
JP 2007-163131 A 6/2007
JP 2010-101617 A 5/2010

*Primary Examiner* — Leonard R Leo
(74) *Attorney, Agent, or Firm* — Maschoff Brennan

(57) ABSTRACT

Two or more cores (2*a*, 2*b*) in each of which two more types of passage layers through which two or more fluids flow are layered alternately are welded together. The entire bottom portions of the cores (2*a*, 2*b*) are covered with a lower header tank (3), thereby making the fluids flow into the cores (2*a*, 2*b*). A dummy layer (14) through which none of the fluids flow is provided beside a weld side face of each core (2*a*, 2*b*). A weld spacer (18) is welded to the entire peripheral edge of a side plate (16) of the dummy layer (14). A through-hole (16*a*) for draining water in the dummy layer (14) is made near the lower end of the side plate of the dummy layer (14). Further, a liquid drain hole (20) through which water is drained is made at a lower corner of the weld spacer (18).

5 Claims, 8 Drawing Sheets

(52) U.S. Cl.
CPC ..... *F28D 9/0062* (2013.01); *F28F 3/025* (2013.01); *F28F 9/185* (2013.01); *F28F 19/006* (2013.01); *F28F 2210/08* (2013.01); *F28F 2265/06* (2013.01); *F28F 2265/14* (2013.01); *F28F 2265/22* (2013.01); *F28F 2275/06* (2013.01)

(58) Field of Classification Search
USPC ..... 165/11.1, 70, 134.1, 166
See application file for complete search history.

(56) References Cited

U.S. PATENT DOCUMENTS 3,517,731 A 6/1970 Rothman
3,633,661 A * 1/1972 Duncan ..... F28D 9/0062 165/166
4,177,858 A * 12/1979 Daman ..... F28D 15/0275 165/70
4,607,684 A * 8/1986 Wiard ..... F28D 1/0213 165/166
5,718,284 A * 2/1998 Nishishita ..... F28F 13/04 165/134.1
5,860,470 A * 1/1999 Andersson ..... F28F 3/083 165/134.1
8,985,192 B2 * 3/2015 Mitsuhashi ..... F28D 9/0062 165/11.1
2007/0136037 A1 6/2007 Holzi
2007/0151276 A1 * 7/2007 Bogart ..... B01D 5/0015 165/166
2010/0181053 A1 7/2010 Hecht et al.
2011/0022367 A1 1/2011 Hoelzl
2014/0054022 A1 * 2/2014 Mitsuhashi ..... F28D 9/0062 165/185

* cited by examiner

HEAT EXCHANGER

TECHNICAL FIELD

The present invention relates to a heat exchanger including two or more cores welded together and each including two or more types of passage layers which are layered alternately and through which two or more fluids at different temperatures flow, and in particular to a structure to drain liquid such as water that has accumulated in the heat exchanger.

BACKGROUND ART

A plate-type heat exchanger which includes a plurality of first passages through which a first fluid flows, a plurality of second passages through which a second fluid flows, and a heat exchange portion in which heat is exchanged between the first passages and the second passages has been known (see Patent Document 1). The heat exchange portion of this plate-type heat exchanger includes, as heat exchange passages, the first passages through which the first fluid flows and the second passages through which the second fluid passes. These first and second passages are arranged, for example, in heat-exchange packages in each of which two or more of the first passages and two or more of the second passages are layered alternately. Between adjacent ones of these packages each comprised of the first and second passages, a layer through which no fluid flows (i.e. an inactive layer) is interposed.

CITATION LIST

Patent Document

Patent Document 1: Japanese Unexamined Patent Publication No. 2010-101617

SUMMARY OF THE INVENTION

Technical Problem

If a heat exchanger includes a layer through which no fluid passes as described in Patent Document 1 and if water that has accumulated inside the heat exchanger due to, e.g., the occurrence of condensation is not drained, a fluid at a low temperature which passes through a core freezes the water. The frozen water increases in volume, and pushes and expands the inactive layer, which disadvantageously deforms the fluid passages that are essential components and adversely affects the performance and the life of the heat exchanger. In the case where the lower face of the core is only partially covered with a header tank as described in Patent Document 1, the water in the layer through which no fluid flows can be drained if a through-hole is made in the lower face of this layer within the portion that the header tank does not cover.

However, if the lower face of the core is almost entirely covered with the lower header tank, no such through-hole can be made.

For example, if two or more types of fluids are to be treated in a single heat exchanger, or if the treatment capacity of a heat exchanger is to be increased, the size of the heat exchanger needs to be increased. In this case, due to constraints such as the size of a brazing furnace, it may be necessary that a plurality of cores are made first, and the cores that have been subjected to the brazing are then welded together. If a single lower header tank is coupled to the entirety of the lower faces of the welded cores, it becomes impossible to drain liquid present near the side plates of the cores that are welded together.

In addition, if the lower end of an outer sidewall of the core is also covered with a side-header tank, a through-hole must be made above the side-header tank. With this configuration, it is impossible to completely drain water that has accumulated inside, and consequently, the remaining water is disadvantageously frozen.

In view of the foregoing, it is therefore an object of the present invention to reliably drain liquid present inside a dummy layer by employing a simple structure.

Solution to the Problem

To achieve the object, according to the present invention, liquid that has flowed into a space defined by a weld spacer is drained through a liquid drain hole made at a lower corner of the weld spacer.

Specifically, the present invention relates to a heat exchanger including two or more cores welded together and each including two or more types of passage layers which are layered alternately and through which two or more fluids at different temperatures flow.

The heat exchanger further includes:

a lower header tank which entirely covers bottom portions of the cores, and makes the fluids flow into the cores;

a dummy layer which is provided beside a weld side face of each core, and through which none of the fluids flow;

a weld spacer which is fixed to an entire peripheral edge of a side plate of the dummy layer;

a through-hole which is made near a lower end of the side plate of the dummy layer, and through which liquid in the dummy layer is drained; and a liquid drain hole which is made at a lower corner of the weld spacer, and through which the liquid in the space is drained.

Thus, the "dummy layer" is provided to prevent dents from being made in the layers through which fluids flow. Such dents may be made during, e.g., the handling when the cores are subjected to vacuum brazing or welding, and can interrupt the flows of the fluids in the layers once they are made. Since no fluids flow through the dummy layer, the periphery of the dummy layer is covered, almost hermitically, with appropriate members such as side bars. In this regards, if the periphery of the dummy layer was covered perfectly hermetically, inconvenience would be caused when vacuum brazing is performed or when an internal pressure needs to be released, for example. Therefore, a clearance of some kind is provided in the periphery, which allows liquid such as water to accumulate in the dummy layer when condensation occurs or when a pressure test is conducted. To release this liquid, a through-hole is made near the lower end of the side plate of the dummy layer. The liquid that has been drained through this through-hole flows into a space surrounded by a weld spacer provided between the two cores. According to conventional structures, since the weld spacer and each core are welded hermetically to each other, the liquid that has flowed into the space cannot be drained. However, with the structure as described above, the liquid drain hole made at the lower corner of the weld spacer enables complete drainage of the liquid through the same. Thus, no liquid is allowed to remain to be frozen. Here, the "liquid" is usually water, which may contain impurities. In some instances, the "liquid" may be a liquid other than water.

It is preferable that the weld spacer be comprised of a plurality of bar-like members, and the liquid drain hole be implemented as a clearance between two of the bar-like members. In this case, with the simple structure in which a clearance is provided between the bar-like members that constitute the weld spacer, the liquid that has flowed from the dummy layer is drained through the clearance.

The liquid drain hole may be made between obliquely-cut tips of two of the bar-like members, and may extend toward a lower corner of the core. Thus, the liquid drain hole can be made by obliquely cutting the tips of two bar-like members, which makes the fabrication of the heat exchanger easy.

It is preferable that a cylindrical member should be fixed to the outer peripheral edge of the liquid drain hole, and the inside of the cylindrical member communicate with the liquid drain hole. The cylindrical member provided in this manner allows for preventing the liquid drain hole from being plugged by weld beads formed when the weld spacer is welded and when the lower header tank is welded. The cylindrical member suitably has a hollow structure to ensure the communication with or plugging of the liquid drain hole, and its cross section is not limited to any particular shape.

Further, the cylindrical member is preferably capable of receiving a plugging member which is detachable and capable of plugging the liquid drain hole. When no liquid needs to be drained, for example, before installation, during transportation and a stop, the entry of foreign substances is prevented by plugging the cylindrical member provided in this manner. The plugging member is not particularly limited, as long as it is capable of detachably plugging the liquid drain hole made in the cylindrical member. The plugging member may be screwed or pressed into the cylindrical member.

Advantages of the Invention

As described above, according to the present invention, the through-hole through which liquid in the dummy layer is drained is made near the lower end of the side plate of the dummy layer, and the liquid drain hole through which the liquid that has flowed out of the through-hole is drained is made at a lower corner of the weld spacer. Thus, with this simple structure, the liquid in the dummy layer is drained reliably. Therefore, the present invention allows for preventing the liquid from remaining to be frozen and from adversely affecting the heat exchanger.

DESCRIPTION OF EMBODIMENTS

Embodiments of the present invention will be described below with reference to the drawings.

Figure 2:
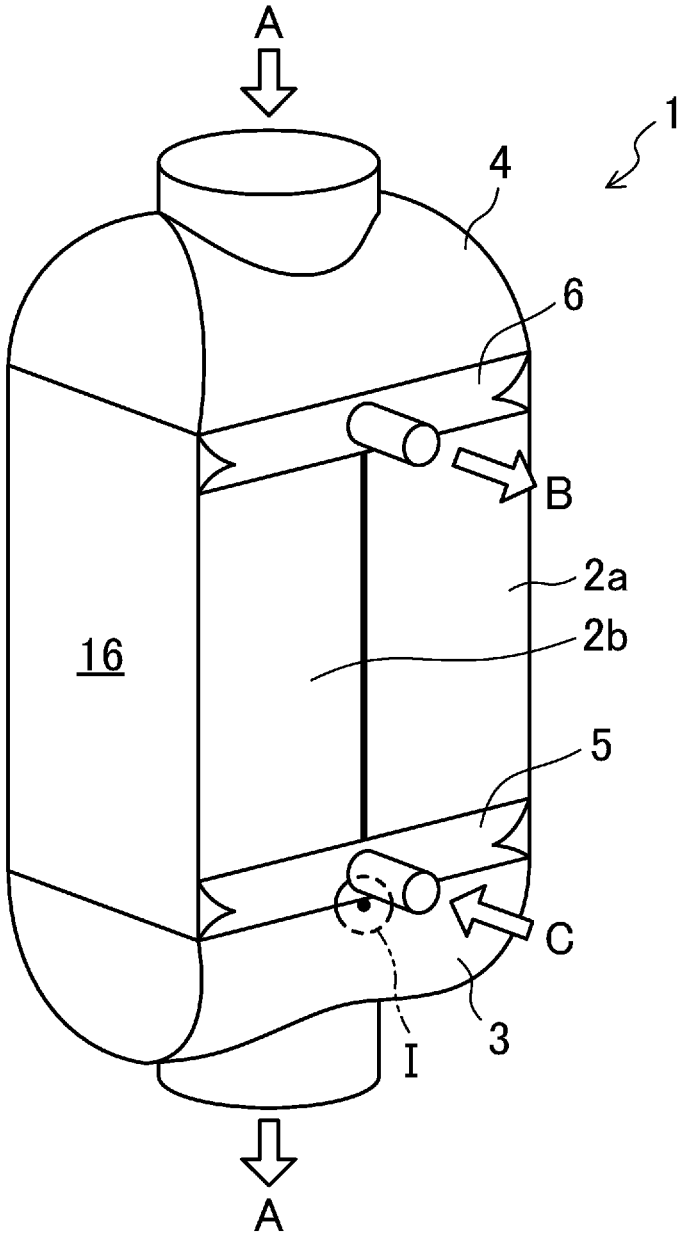
FIG. 2 is a perspective view showing a heat exchanger according to an embodiment of the present invention.
Figure 3A:
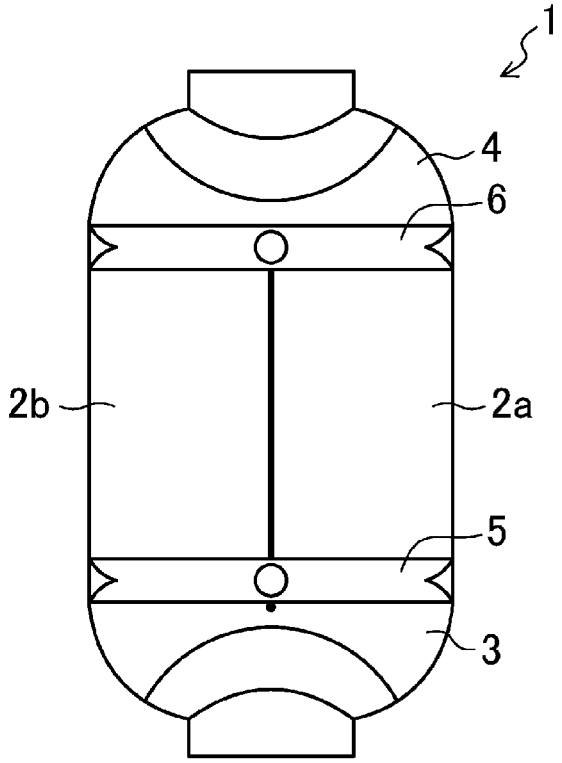
FIGS. 3A and 3B are a front view and a side view of a heat exchanger, respectively.
Figure 3B:
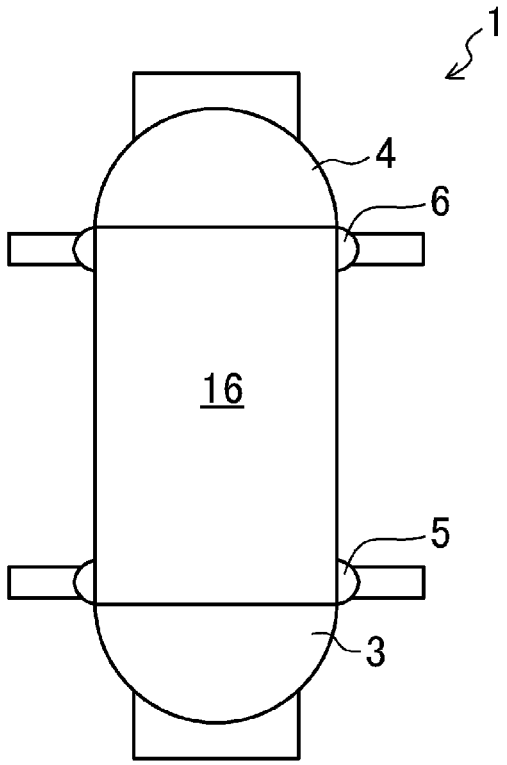
Figure 4:
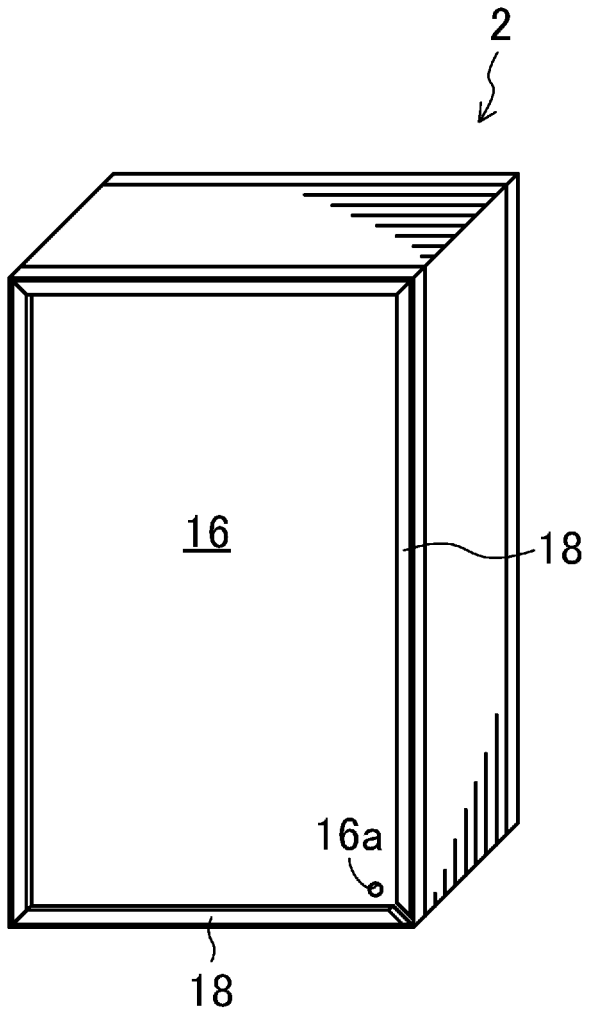
FIG. 4 is a perspective view showing a core.

FIGS. 2 and 3 show a heat exchanger 1 according to an embodiment of the present invention. This heat exchanger 1 is implemented, for example, as a plate-fin-type heat exchanger 1 that is mainly made of an aluminum alloy. As shown in FIG. 4, the heat exchanger 1 of this embodiment includes two cores 2*a* and 2*b*. In each of the cores 2*a* and 2*b*, two or more types of passage layers through which two or more fluids at different temperatures flow are layered alternately. The cores 2*a* and 2*b* are welded to each other. The bottom portions of these cores are covered almost entirely with a lower header tank 3, and the top portions of the cores are covered almost entirely with an upper header tank 4. To side faces of the core 2, four side-header tanks 5 and 6, in total, are coupled, for example.

Figure 5:
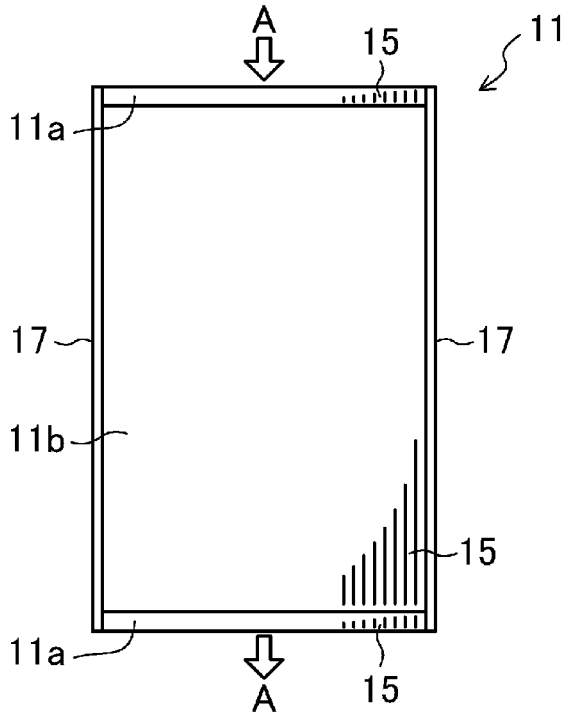
FIG. 5 is a side view showing a first passage layer.
Figure 6:
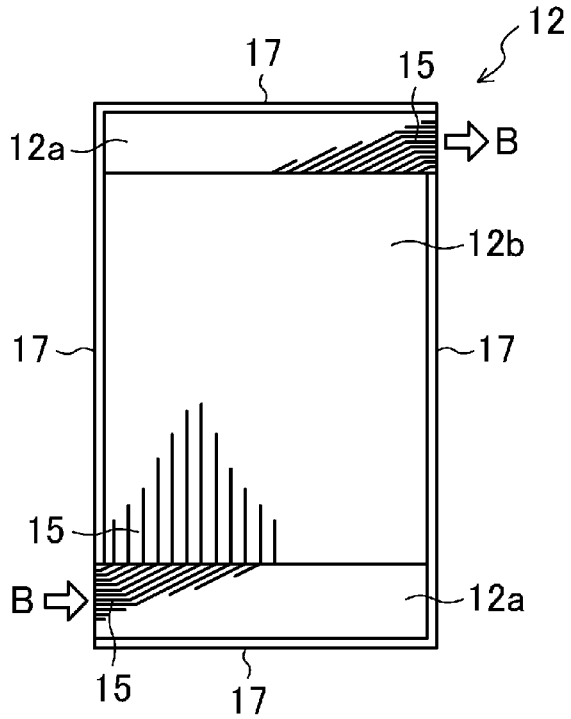
FIG. 6 is a side view showing a second passage layer.
Figure 7:
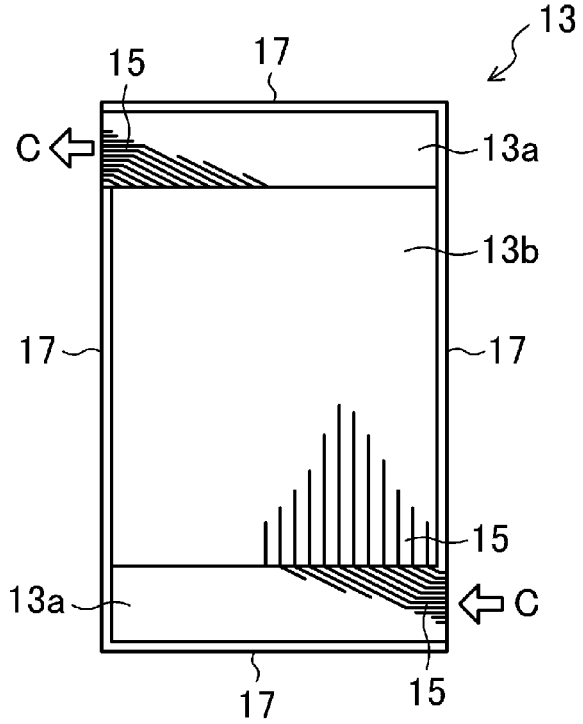
FIG. 7 is a side view showing a third passage layer.

Each of the cores 2*a* and 2*b* includes three types of fluid passage layers, for example. FIG. 5 shows a first fluid passage layer 11. As shown in FIGS. 2 and 3, a fluid A flows through the first fluid passage layer 11 from the upper header tank 4 to the lower header tank 3. The first fluid passage layer 11 includes, at each of its upper and lower ends, a distributer portion 11*a* which extends vertically. The first fluid passage layer 11 further includes a heat-transfer fin portion 11*b* which extends vertically between its upper and lower ends. For the sake of convenience, in the drawings, the intervals between the passages are wider than the actual ones and simplified. FIG. 6 shows a second fluid passage layer 12. As shown in FIGS. 2 and 3, a fluid B flows through the second fluid passage layer 12 from one of lower side-header tanks 5 that is on a side face of the core to one of upper side-header tanks 6 that is on the opposite side face of the core. The second fluid passage layer 12 includes, at each of its upper and lower ends, a distributer portion 12*a* which extends obliquely. The second fluid passage layer 12 further includes a heat-transfer fin portion 12*b* which extends vertically between its upper and low ends. FIG. 7 shows a third fluid passage layer 13. As shown in FIGS. 2 and 3, a fluid C flows through the third fluid passage layer 13 from the other one of the lower side-header tanks 5 that is on another side face of the core to the other one of the upper side-header tanks 6 that is on the opposite side face of the core. The third fluid passage layer 13 includes, at each of its upper and lower ends, a distributer portion 13*a* which extends obliquely. The third fluid passage layer 13 further includes a heat-transfer fin portion 13*b* which extends vertically between its upper and low ends. In each of the cores 2*a* and 2*b*, these three types of passage layers 11, 12, and 13 are layered one on the other. The three different fluids A, B, and C are at different temperatures, and heat is exchanged between the different fluids that are at different temperatures and passing through the adjacent ones of the fluid passage layers. For example, the fluids may be air at a temperature below the freezing point, nitrogen, oxygen, argon or other substances that are obtained by low temperature separation of air.

Figure 8:
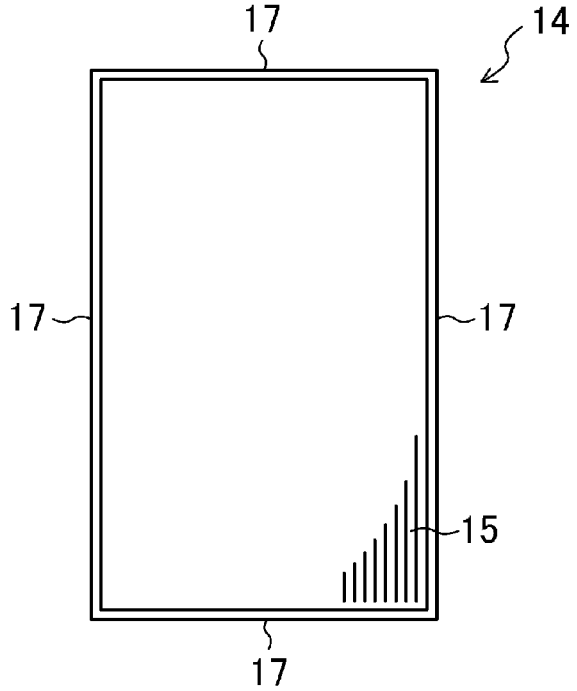
FIG. 8 is a side view showing a dummy layer.
Figure 9:
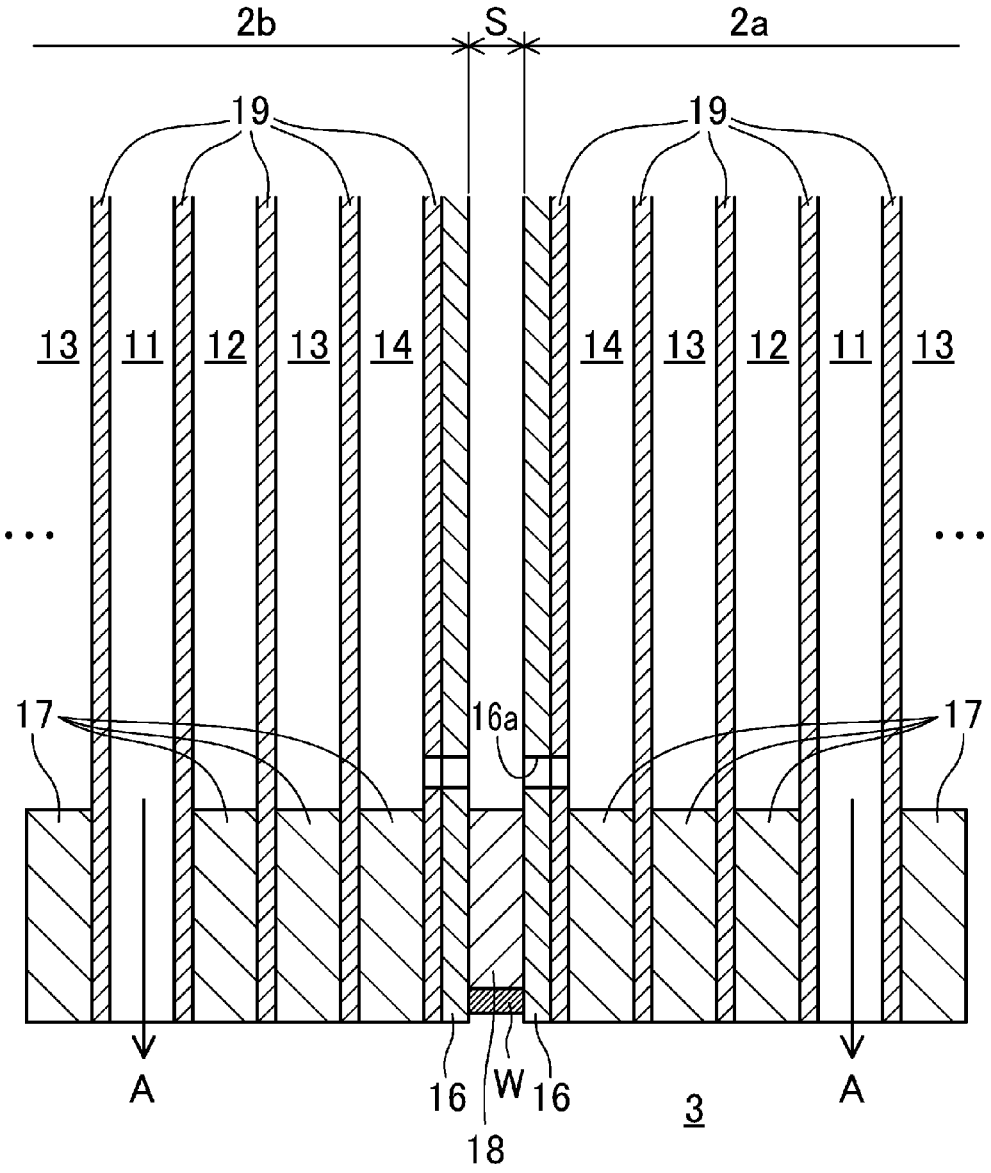
FIG. 9 is an enlarged cross-sectional view taken along the plane IX-IX in FIG. 1.

FIG. 8 shows a dummy layer 14 through which no fluid flows. The dummy layer 14 forms each of the right and left outer layers of the cores 2*a* and 2*b*. As shown in FIG. 9 that is an enlarged cross-sectional view, the fluid passage layers 11, 12, and 13 and the dummy layer 14 are formed in the following manner: Corrugated fins 15 that have been formed and cut are each sandwiched between tube plates 19 together with a brazing filler (not shown), and an outer side of each of the dummy layers 14 is covered with a side plate 16, and thereafter, the layered components and side bars 17 are subjected to vacuum brazing. At this time, the corrugated fins 15 are formed and brazed such that its height and pitches are kept highly uniform. The brazing filler may be, in advance, rolled on and integrated with the tube plates 19 made of an aluminum alloy. A portion of predetermined ones of the side bars 17 of each passage layer are cut off to allow the associated fluid to pass, thereby establishing communication with the associated header tank. All of the four side bars 17 of each dummy layer 14 are continuous. Although each dummy layer 14 may include no corrugated fins 15, the corrugated fin 15 is usually provided to extend vertically in each dummy layer 14 in order to ensure the strength.

The order in which the fluid passage layers 11, 12, and 13 are layered is not particularly limited. However, as shown in FIG. 9, in each of the cores 2*a* and 2*b*, the side plate 16, the tube plate 19, the dummy layer 14, the tube plate 19, the third fluid passage layer 13, the tube plate 19, the second fluid passage layer 12, the tube plate 19, the first fluid passage layer 11, the tube plate 19, the third fluid passage layer 13 . . . are layered in this order from one end. The dummy layer 14, the tube plate 19, and the side plate 16 are also arranged toward the other end. The configuration of these fluid passage layers 11, 12, and 13 is not particularly limited. Only two types of fluid passage layers or four or more types of fluid passage layers may be arranged. The type of flow directions in which the fluids flow are not particularly limited, but may be a cross flow type in which the flows are perpendicular to each other, a counterflow type in which the flows are opposite to each other, or a combination of these types. The configurations of the header tanks may be suitably altered in accordance with the fluid passages layers. For example, the side-header tanks 5 and 6 may be omitted or positioned differently from this embodiment. For example, if no side-header tanks 5 and 6 are provided, each of the lower header tank 5 and the upper header tank 4 may be divided into two sections.

Figure 1:
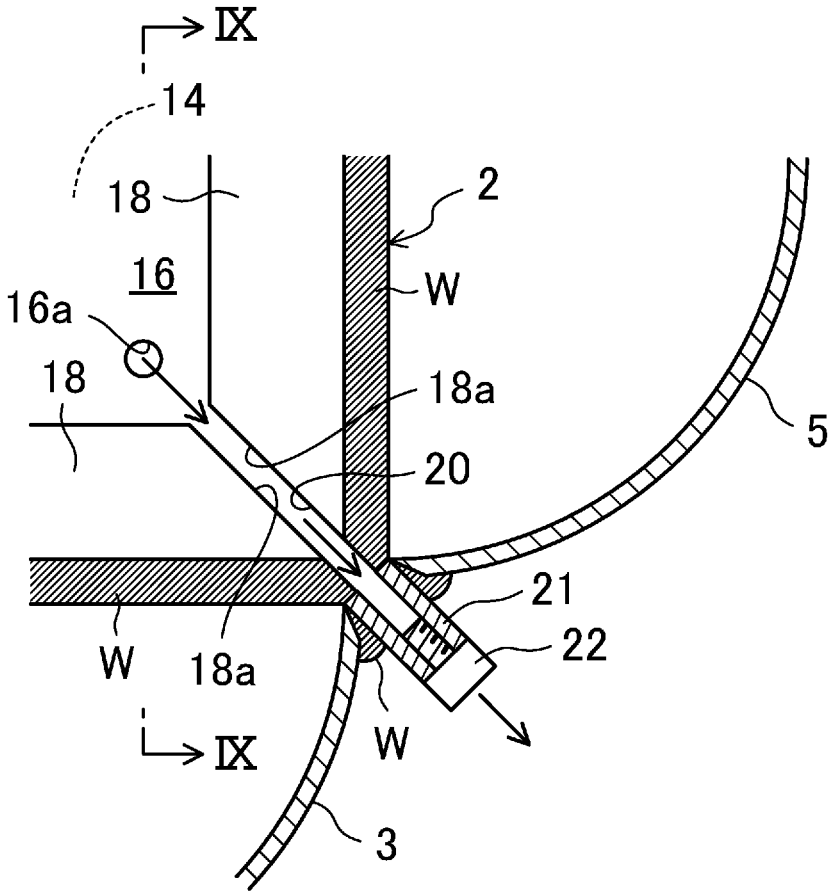
FIG. 1 is an enlarged view showing the portion denoted by reference character I in FIG. 2.

As shown in FIGS. 1 and 4, a weld spacer 18 is welded, in a frame shape, to the entire peripheral edge of one of the side plates 16 of the two dummy layers 14 that face each other. This weld spacer 18 is made of a plate of an aluminum alloy having a predetermined thickness, for example. The frame-shaped weld spacer 18 defines a space S between the two side plates 16.

On the other hand, at least one through-hole 16*a* is made near the lower end of each of the side plates 16 that are provided on the weld sides of the cores 2*a* and 2*b* facing each other. The liquid, i.e. water, in each dummy layer 14 can be drained through the associated through-hole 16*a*.

The weld spacer 18 has, at its lower corner, a liquid drain hole 20 through which water that has flowed into the space S defined by the weld spacer 18 is drained. This liquid drain hole 20 is positioned between obliquely-cut tips 18*a* of two bar-like members which constitute the weld spacer 18 and which extend perpendicularly to each other. In this manner, the liquid drain hole 20 can be made simply by obliquely cutting the tips 18*a* of the two bar-like members.

Further, a cylindrical member which is implemented as a hollow cylindrical plug-receiving boss 21 is fixed to the outer peripheral edge of the liquid drain hole 20. The plug-receiving boss 21 suitably has a hollow structure to ensure the communication with the liquid drain hole 20, and its cross section is not limited to any particular shape. To this plug-receiving boss 21, a plugging member for plugging the liquid drain hole 20, which is implemented as a plug 22, can be attached. The plug 22 is not particularly limited, as long as the plug 22 is capable of plugging a liquid drain hole made in the boss. The plug 22 may be screwed or pressed into the boss.

The plug-receiving boss 21 is welded when the two cores 2*a* and 2*b* are welded to each other. Specifically, the weld spacer 18 is welded to the side plate 16 of one core 2*a*, first. At this time, no weld bead W is formed in the portion that is to serve as the liquid drain hole 20.

Thereafter, the weld spacer 18 is brought into contact with, and welded to, the side plate 16 of the other core 2*b*. Also at this time, no weld bead W is formed in the portion that is to serve as the liquid drain hole 20. The plug-receiving boss 21 is then fitted into the liquid drain hole 20, and the outer periphery of the plug-receiving boss 21 is welded. It is also possible that another weld spacer 18 is welded to the other core 2*b* in advance, and the two weld spacers 18 are brought into contact with, and welded to, each other such that the gap between their outer peripheries is filled.

Thereafter, the lower header tank 3 and the lower side-header tanks 5 are welded. Consequently, weld beads W formed at this time are not allowed to plug the liquid drain hole 20.

As can be seen from the foregoing, the plug-receiving boss 21 that is provided and welded to the liquid drain hole 20 prevents the liquid drain hole 20 from being filled with the weld beads W, thereby ensuring the drainage of liquid. When the welding is performed, the plug-receiving boss 21 ensures the communication with the liquid drain hole 20, which makes the welding easy and increases the workability significantly.

In the thus configured heat exchanger 1, the presence of the dummy layers 14 prevents the fluid passage layers 11, 12, and 13 from being damaged during, e.g., the handling of the cores 2*a* and 2*b* when they are subjected to vacuum brazing or welding.

Since no fluids flow through each dummy layer 14, the periphery of each dummy layer 14 is covered with the side bars 17 almost hermetically. In this regard, if the periphery of each dummy layer 14 was covered perfectly hermetically, inconvenience would be caused when vacuum brazing is performed or when the internal pressures of the cores 2*a* and 2*b* need to be released, for example. Therefore, a clearance of some kind is provided in the periphery, which allows water to accumulate in the dummy layer 14 when a pressure test is conducted using water or when condensation occurs, for example. As indicated by the arrows in FIG. 1, such water is drained through the through-hole 16*a* provided near the lower end of each side plate 16, and flows into the space surrounded by the weld spacer 18 provided between the two cores 2*a* and 2*b*.

With the plug 22 detached, the water can be drained through the liquid drain hole 20 made at the lower corner of the weld spacer 18. In order to drain the water with more reliability, the heat exchanger 1 may be tilted. Thus, no water is allowed to remain to be frozen even if the fluids A, B, and C that are at temperatures below the freezing point are made to flow through the heat exchanger 1.

When no water needs to be drained, the plug-receiving boss 21 is plugged with the plug 22. This allows for preventing foreign substances from entering the heat exchanger 1, thereby maintaining the quality of the heat exchanger 1.

As described above, in the heat exchanger 1 according to this embodiment of the present invention, the through-hole 16*a* through which water in the dummy layer 14 is drained is made near the lower end of the side plate of the dummy layer 14, and the liquid drain hole 20 through which the water that has flowed out of the through-hole 16*a* is drained is made at the lower corner of the weld spacer 18. Thus, with this simple structure, the water in the dummy layer 14 can be drained with reliability. The present invention effectively allows for preventing the heat exchanger 1 from being damaged by frozen water.

The heat exchanger 1 according to this embodiment is implemented as a plate-fin-type heat exchanger. Therefore, the tube plates 19 serve as a primary heat-transfer surface, and the corrugated fins 15 brazed between the tube plates 19 serve as a secondary heat-transfer surface and a reinforcing member against an internal pressure.

(Other Embodiments)

The heat exchanger of the above embodiment of the present invention may be configured as follows.

Figure 10A:
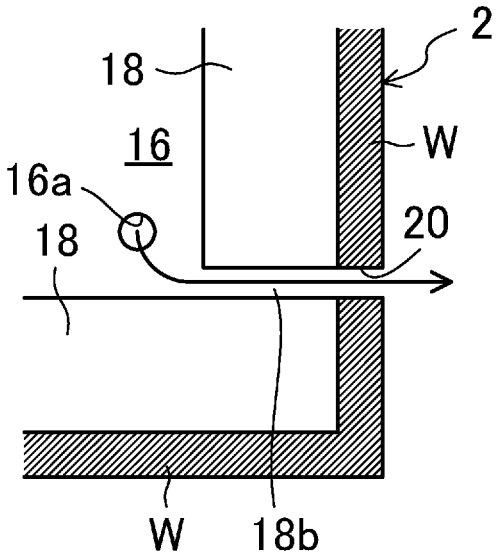
FIGS. 10A and 10B are cross-sectional views corresponding to FIG. 1, and each show a configuration of a weld spacer according to another embodiment.
Figure 10B:
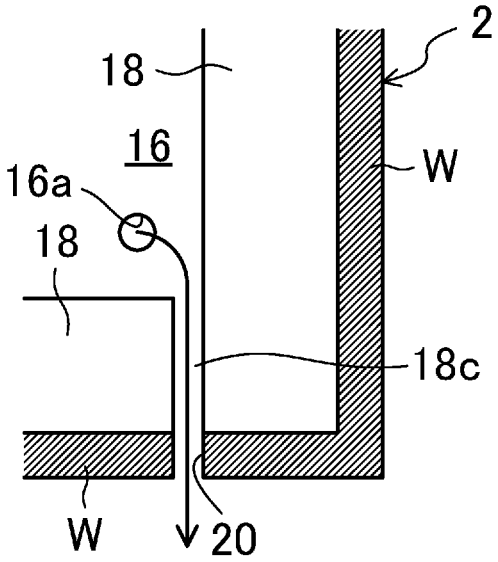

In the above embodiment, the tips 18*a* of the bar-like members of the weld spacer 18 are obliquely cut to make the liquid drain hole 20. However, as shown in FIG. 10A, it is possible that the lower horizontal bar-like member of the weld spacer 18 is not cut, while the right vertical bar-like member of the weld spacer 18 is shortened to produce a clearance 18*b*. This clearance 18*b* may be used to make a liquid drain hole 20. This configuration is advantageous when no lower side-header tank 5 is provided at the lower end of the core 2. Alternatively, as shown in FIG. 10B, it is possible that the right vertical bar-like member of the weld spacer 18 is not cut, while the lower horizontal bar-like member of the weld spacer 18 is shortened to produce a clearance 18*c*. This clearance 18*c* may be used to make a liquid drain hole 20. This configuration is advantageous when the lower header tank 3 is displaced inward. In each case, it is preferable to provide a plug-receiving boss 21. Thus, these simple structures in which the clearances 18*b* and 18*c* are produced between the bar-like members that constitute the weld spacer 18 allow for draining, through the clearances 18*b* and 18*c*, the water that has flowed from the dummy layer 14.

Though the above embodiment includes only one liquid drain hole 20, another liquid drain hole may be made at the opposite corner.

Though the heat exchanger 1 of the above embodiment is made of an aluminum alloy, the heat exchanger may be made of other metals, such as a stainless alloy.

In the above embodiment, the plug-receiving boss 21 is provided to prevent the beads W from plugging the liquid drain hole 20. However, the plug-receiving boss 21 does not have to be provided, and welding may be performed such that the liquid drain hole 20 is not plugged and is made to communicate with outside air. In such a case, a plugging member of some kind may also be provided detachably.

The foregoing embodiments are merely preferred examples in nature, and are not intended to limit the scope, applications, and use of the invention.

INDUSTRIAL APPLICABILITY

As described above, the present invention is useful for a heat exchanger including two or more cores welded together and each including two or more types of passage layers which are layered alternately and through which two or more fluids flow.

DESCRIPTION OF REFERENCE CHARACTERS

1 Heat Exchanger
2 Core
3 Lower Header Tank
4 Upper Header Tank
5 Lower Side-header Tank
6 Upper Side-header Tank
11 First Fluid Passage Layer
12 Second Fluid Passage Layer
13 Third Fluid Passage Layer
14 Dummy Layer
15 Corrugated Fin
16 Side Plate
16*a* Through-hole
17 Side Bar
18 Weld Spacer
19 Tube Plate
20 Liquid Drain Hole
21 Plug-receiving Boss (Cylindrical Member)
22 Plug (Plugging Member)

The invention claimed is:

1. A heat exchanger including two or more cores welded together and each including two or more types of passage layers which are layered alternately and through which two or more fluids at different temperatures flow, the heat exchanger comprising:

a lower header tank which entirely covers bottom portions of the cores and makes the fluids flow into the cores;

a dummy layer which is provided at least beside a weld side face of each core, and through which none of the fluids flow;

a weld spacer which is fixed to a peripheral edge of a side plate of the dummy layer;

a through-hole which is made near a lower end of the side plate of the dummy layer, and through which liquid in the dummy layer is drained into a space defined by the weld spacer; and a liquid drain hole which is made at a lower corner of the weld spacer, and through which the liquid in the space is drained.

2. The heat exchanger of claim 1, wherein:

the weld spacer is comprised of a plurality of bar-like members, and the liquid drain hole is implemented as a clearance between two of the plurality of bar-like members.

3. The heat exchanger of claim 2, wherein:

the liquid drain hole is made between obliquely-cut tips of the two of the plurality of bar-like members, and the liquid drain hole extends toward a lower corner of the core.

4. The heat exchanger of claim 1, further comprising a cylindrical member that is fixed to an outer peripheral edge of the liquid drain hole, wherein an inside of the cylindrical member communicates with the liquid drain hole.

5. The heat exchanger of claim 1, further comprising a cylindrical member that is capable of receiving a plugging member which is detachable and capable of plugging the liquid drain hole.

* * * * *